US010047742B2

(12) United States Patent
Wang

(10) Patent No.: US 10,047,742 B2
(45) Date of Patent: Aug. 14, 2018

(54) PUMP OPERABLE IN ONE OF QUICK PUMPING MODE AND HIGH-PRESSURE PUMPING MODE SELECTIVELY

(71) Applicant: BETO ENGINEERING AND MARKETING CO., LTD., Taichung (TW)

(72) Inventor: Lopin Wang, Taichung (TW)

(73) Assignee: BETO ENGINEERING AND MARKETING CO., LTD., Taichung (TW)

( * ) Notice: Subject to any disclaimer, the term of this patent is extended or adjusted under 35 U.S.C. 154(b) by 189 days.

(21) Appl. No.: 15/287,347

(22) Filed: Oct. 6, 2016

(65) Prior Publication Data

US 2018/0100499 A1 Apr. 12, 2018

(51) Int. Cl.

| | |
|---|---|
| ***F04B 33/00*** | (2006.01) |
| ***F04B 53/10*** | (2006.01) |
| ***F04B 37/12*** | (2006.01) |
| ***F04B 27/10*** | (2006.01) |
| ***F04B 27/00*** | (2006.01) |
| ***F04B 49/22*** | (2006.01) |

(52) U.S. Cl.

CPC ..... *F04B 53/10* (2013.01); *F04B 27/005* (2013.01); *F04B 27/1045* (2013.01); *F04B 33/00* (2013.01); *F04B 37/12* (2013.01); *F04B 49/22* (2013.01)

(58) Field of Classification Search

CPC ..... F04B 33/00; F04B 33/005; F04B 53/10

See application file for complete search history.

(56) References Cited

U.S. PATENT DOCUMENTS 5,012,954 A * 5/1991 Will ..... B60C 23/10 141/330
5,476,372 A * 12/1995 Yang ..... F04B 33/005 417/553
5,947,706 A * 9/1999 Gapinski ..... F04B 33/005 248/125.1
6,883,565 B2 * 4/2005 Marui ..... F04B 33/005 141/18

(Continued)

*Primary Examiner* — Patrick Hamo

(74) *Attorney, Agent, or Firm* — Muncy, Geissler, Olds & Lowe, P.C.

(57) ABSTRACT

A pump includes: a base with a through-hole flanked by an intake-hole and discharge-hole; an external cylinder fixed to the base; an end-fitting element disposed at external cylinder and having a through-hole; an internal cylinder inserted into the through-hole of end-fitting element and thereby partially received in external cylinder to fit coaxially inside external cylinder; a handle fixed to internal cylinder; a delivery pipe fixed to the base's through-hole and received coaxially in internal cylinder; an internal cylinder piston fixed to delivery pipe and received in internal cylinder; an external cylinder piston fixed to internal cylinder, received in external cylinder, and having a through-hole penetrated by delivery pipe; a check-valve disposed in intake-hole to ensure unidirectional gas movement therein; a discharge-valve disposed in discharge-hole; a control element for controlling discharge-valve to open and close; and a guide-channel communicating with the base's through-hole and intake-hole and connected to a nozzle.

4 Claims, 8 Drawing Sheets

(56) References Cited

U.S. PATENT DOCUMENTS 8,414,277 B1 * 4/2013 Hollars ..... F04B 53/10
417/374
8,870,551 B2 * 10/2014 Chuang ..... F04B 33/005
141/54

* cited by examiner

PUMP OPERABLE IN ONE OF QUICK PUMPING MODE AND HIGH-PRESSURE PUMPING MODE SELECTIVELY

BACKGROUND OF THE INVENTION

1. Field of the Invention

The present invention relates to pumps and, more particularly, to a pump operable in one of a quick pumping mode and a high-pressure pumping mode selectively.

2. Description of the Prior Art

A conventional pump comprises an external cylinder and an internal cylinder and can switch between two operation modes, namely a quick pumping mode in which both cylinders are functioning simultaneously, and a high-pressure pumping mode in which only one cylinder is functioning. The conventional pump usually has a discharge valve disposed on the external cylinder (with a large cylinder diameter) or a gas path of the external cylinder. However, the discharge valve is likely to succumb to the pumping pressure after long use and thus ends up with poor airtightness, compromising the performance of large-volume pumping.

SUMMARY OF THE INVENTION

It is an objective of the present invention to provide a pump operable in one of a quick pumping mode and a high-pressure pumping mode selectively, characterized in that the airtightness of a discharge valve of the pump increases with the pumping pressure.

Another objective of the present invention is to provide a pump operable in one of a quick pumping mode and a high-pressure pumping mode selectively, characterized by simple structure and ease of assembly.

In order to achieve the above and other objectives, the present invention provides a pump operable in one of a quick pumping mode and a high-pressure pumping mode selectively, comprising an external cylinder and an internal cylinder, with the external cylinder having therein a discharge valve, the discharge valve having a valve body and a valve hole, the valve body having a rod-shaped body portion, the body portion having an end with a protruding shoulder portion, the body portion being insertedly disposed into the valve hole, wherein a seal ring fits around the body portion and abuts against the shoulder portion, wherein a spring abuts against the shoulder portion such that the seal ring provides a hermetic seal to the valve hole from within the cylinders, wherein a control element pushes the body portion of the valve body from outside to control an opening and closing of the discharge valve. Since the seal ring of the discharge valve provides a hermetic seal to the valve hole from within the cylinders, the higher the internal pressure is during the pumping process, the gas pressure causes the valve body to press against the seal ring under a higher pressure so as to provide a hermetic seal to the valve hole, thereby precluding a leak.

DETAILED DESCRIPTION OF THE EMBODIMENT OF THE INVENTION

Figure 1:
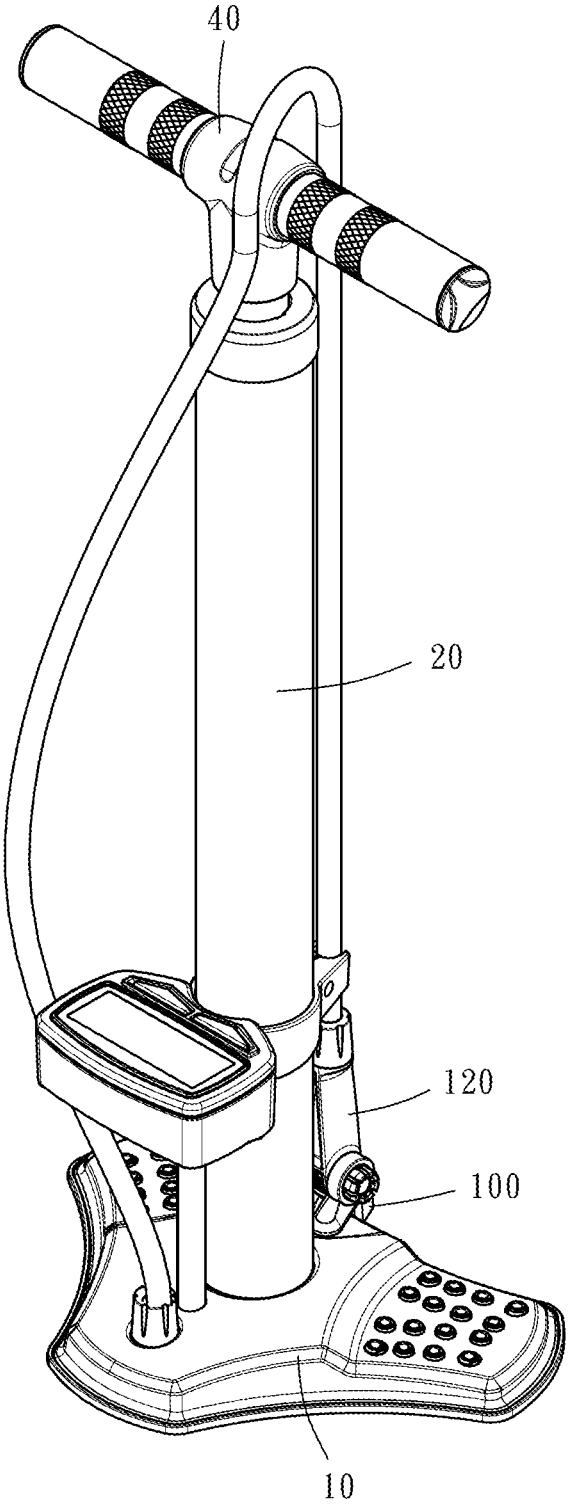
FIG. 1 is a perspective view of a pump operable in one of a quick pumping mode and a high-pressure pumping mode selectively according to an embodiment of the present invention.

Referring to FIG. 1 through FIG. 8, a pump operable in one of a quick pumping mode and a high-pressure pumping mode selectively, provided according to an embodiment of the present invention, comprises a base 10, an external cylinder 20, an end fitting element 25, an internal cylinder 30, a handle 40, a delivery pipe 50, an internal cylinder piston 60, an external cylinder piston 70, a check valve 80, a discharge valve 90, a control element 100, a guide channel 110, and a nozzle 120.

The base 10 is centrally provided with a through hole 11. The through hole 11 is flanked by an intake hole 12 and a discharge hole 13.

The external cylinder 20 has one end fixed to the base 10.

The end fitting element 25 is disposed at the other end of the external cylinder 20 and centrally provided with a through hole 26.

The internal cylinder 30 is insertedly disposed into the through hole 26 of the end fitting element 25 and thereby partially received in the external cylinder 20 so as to fit coaxially inside the external cylinder 20.

The handle 40 is fixed to an exposed end of the internal cylinder 30.

The delivery pipe 50 has one end fixed to the through hole 11 of the base 10 and thereby is received coaxially in the internal cylinder 30.

The internal cylinder piston 60 is fixed to the other end of the delivery pipe 50 and received in the internal cylinder 30.

The external cylinder piston 70 is fixed to the inner end of the internal cylinder 30, received in the external cylinder 20, and centrally provided with a through hole 71 penetrated by the delivery pipe 50.

The check valve 80 is disposed in the intake hole 12 of the base 10 to allow a gas in the external cylinder 20 to unidirectionally enter the base 10 but not allow the gas to reverse and exit.

The discharge valve 90 is disposed in the discharge hole 13 of the base 10.

The control element 100 controls the opening and closing of the discharge valve 90.

The guide channel 110 is in communication with the through hole 11 and the intake hole 12 of the base 10.

The nozzle 120 is connected to the guide channel 110.

The discharge hole 13 of the base 10 has a receiving chamber 14. A valve hole 15 is disposed at the bottom of the receiving chamber 14 and adapted to be in communication with the outside. The discharge valve 90 comprises: a valve body 91 having a rod-shaped body portion 92 with one end having a protruding shoulder portion 93, wherein the rod-shaped body portion 92 is received in the valve hole 15, and a free end of the body portion 92 protrudes from the valve hole 15, with the shoulder portion 93 disposed in the receiving chamber 14; a spring 94 with one end abutting against the shoulder portion 93 of the valve body 91 and the other end fixed in place inside the receiving chamber 14 to push the valve body 91 such that the valve body 91 closes the valve hole 15; a seal ring 95 for fitting around the body portion 92, abutting against the shoulder portion 93, and facing the valve hole 15, so as to prevent a leak; and a baffle 96 fixed to the receiving chamber 14 such that the other end of the spring 94 is fixed in place.

The control element 100 pushes the free end of the body portion 92 of the valve body 91 from outside to open and close the discharge hole 13.

Figure 4:
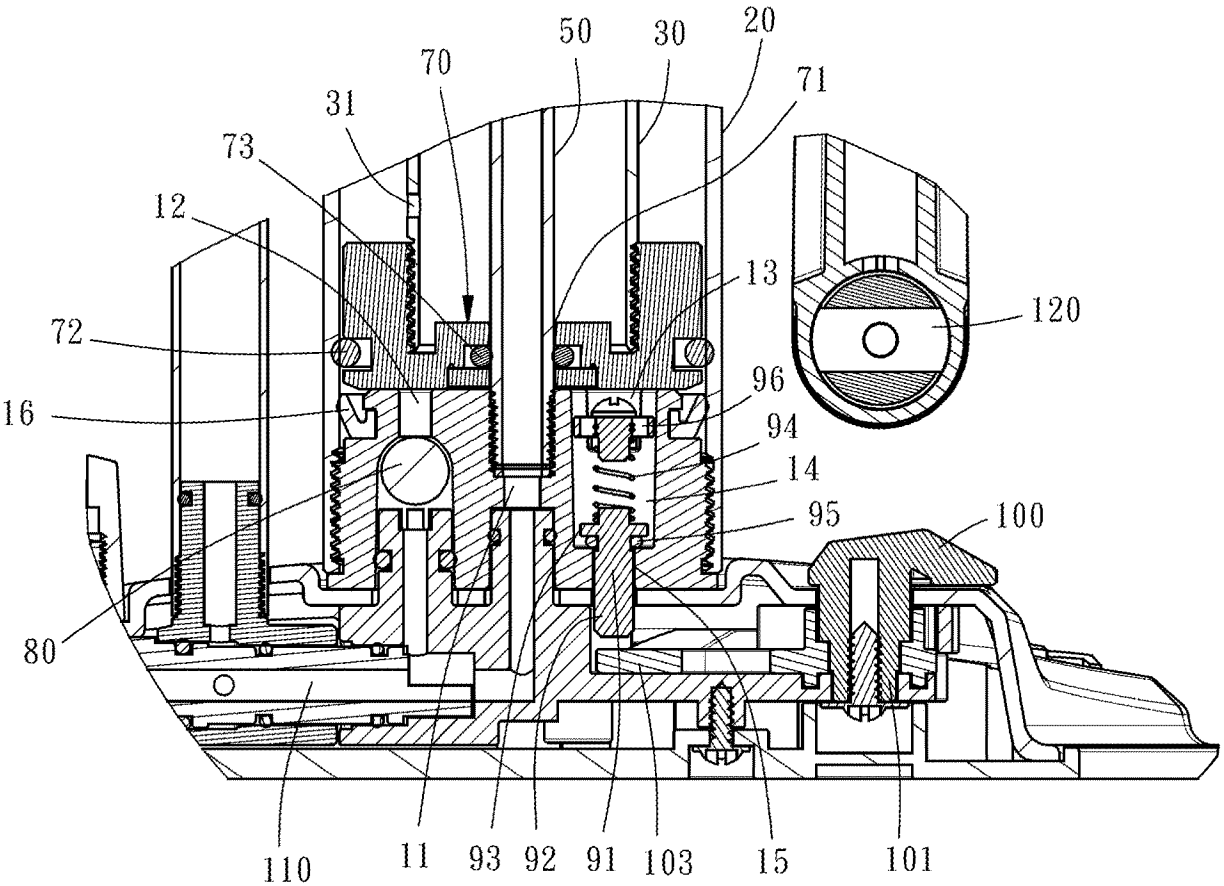
FIG. 4 is an enlarged view of the middle and lower parts of FIG. 3, showing that a discharge valve is closed and ready for low-pressure, large-volume pumping.
Figure 5:
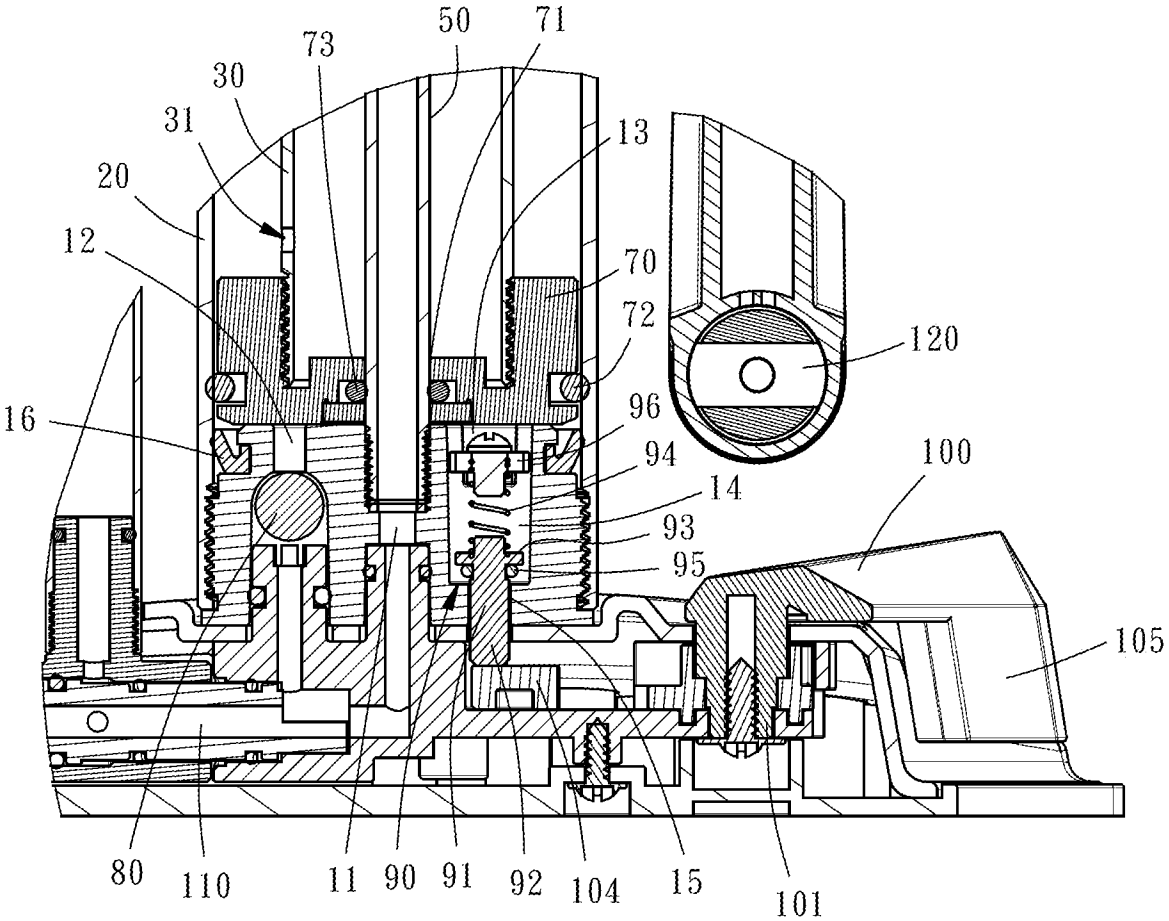
FIG. 5, which is similar to FIG. 4, shows that the discharge valve is open and ready for high-pressure, small-volume pumping.
Figure 6:
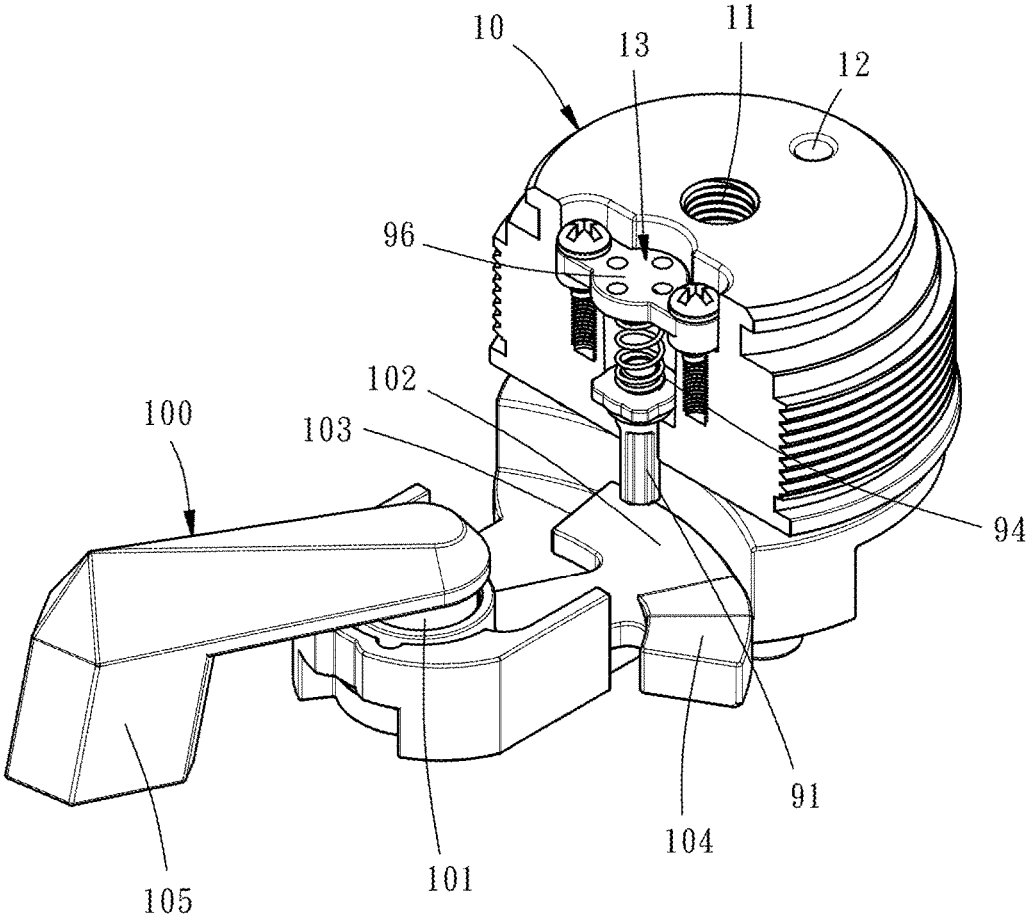
FIG. 6 is a cutaway view of the base and the discharge valve, showing that the discharge valve is closed and ready for low-pressure, large-volume pumping.
Figure 7:
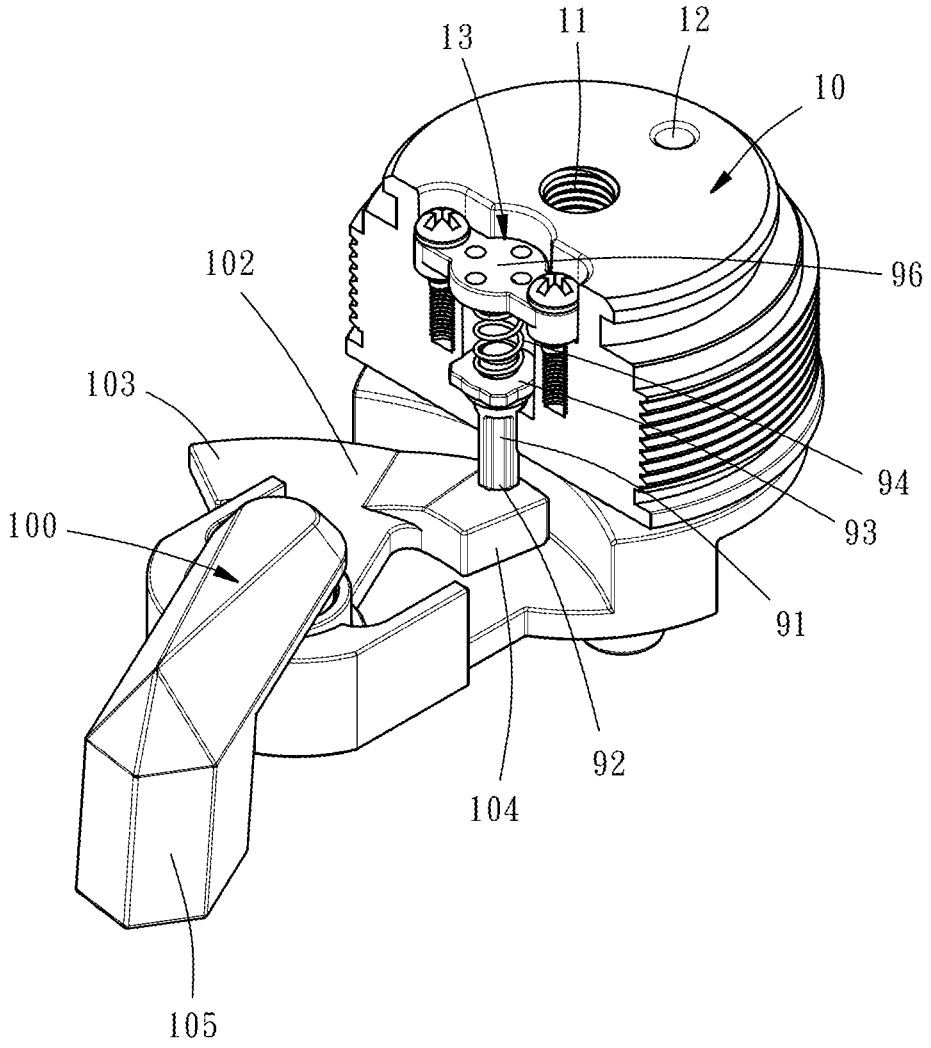
FIG. 7, which is similar to FIG. 6, shows that the discharge valve is open and ready for high-pressure, small-volume pumping.

The control element 100 is slender and centrally, pivotally connected to the lateral side of the base 10 by a shaft 101. One end 102 of the control element 100 is arcuate and disposed below the valve body 91 of the discharge valve 90. The arcuate end 102 has a thin end 103 and a thick end 104. Another end 105 of the control element 100 is disposed outside the base 10 and rotatable under an external force such that the control element 100 can swing and undergo a displacement. When the thin end 103 of the arcuate end 102 is located right below the valve body 91, the discharge valve 90 is closed, as shown in FIGS. 4, 6. When the thick end 104 of the arcuate end 102 is located right below the valve body 91, the free end of the body portion 92 of the valve body 91 is lifted by the thick end 104 to thereby open the valve hole 15, rendering the discharge valve 90 open, as shown in FIGS. 5, 7.

Figure 2:
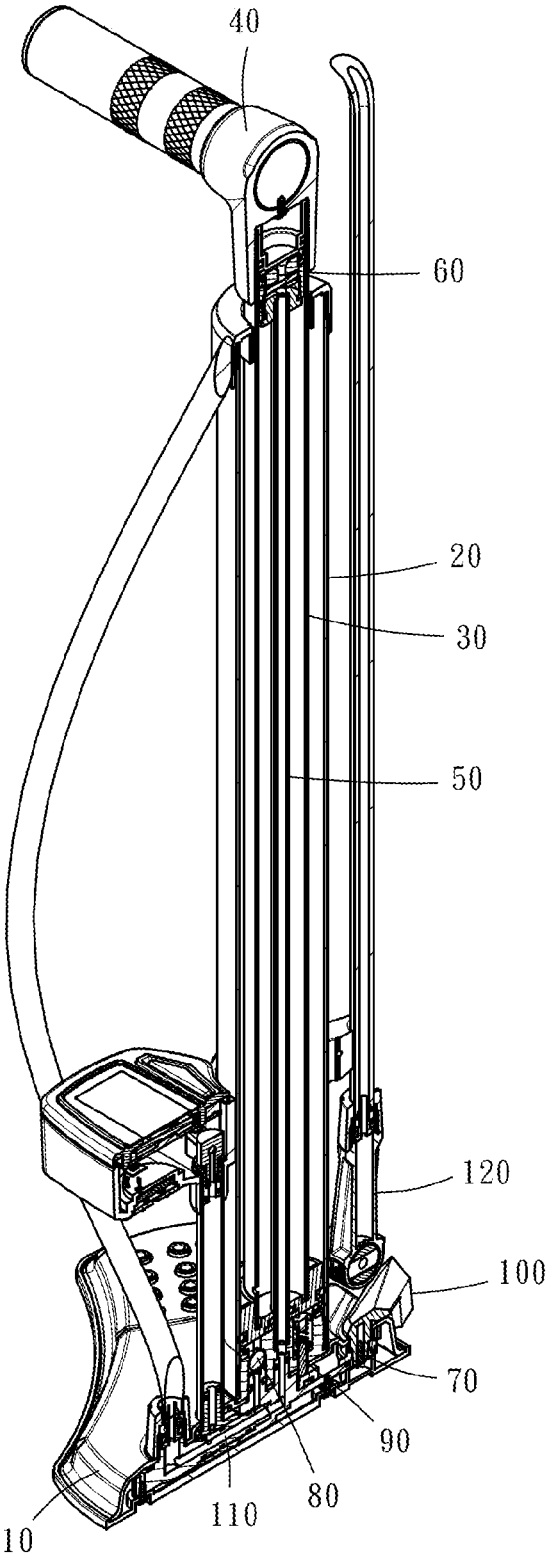
FIG. 2 is a cutaway view of the pump taken along line A-A of FIG. 1.
Figure 8:
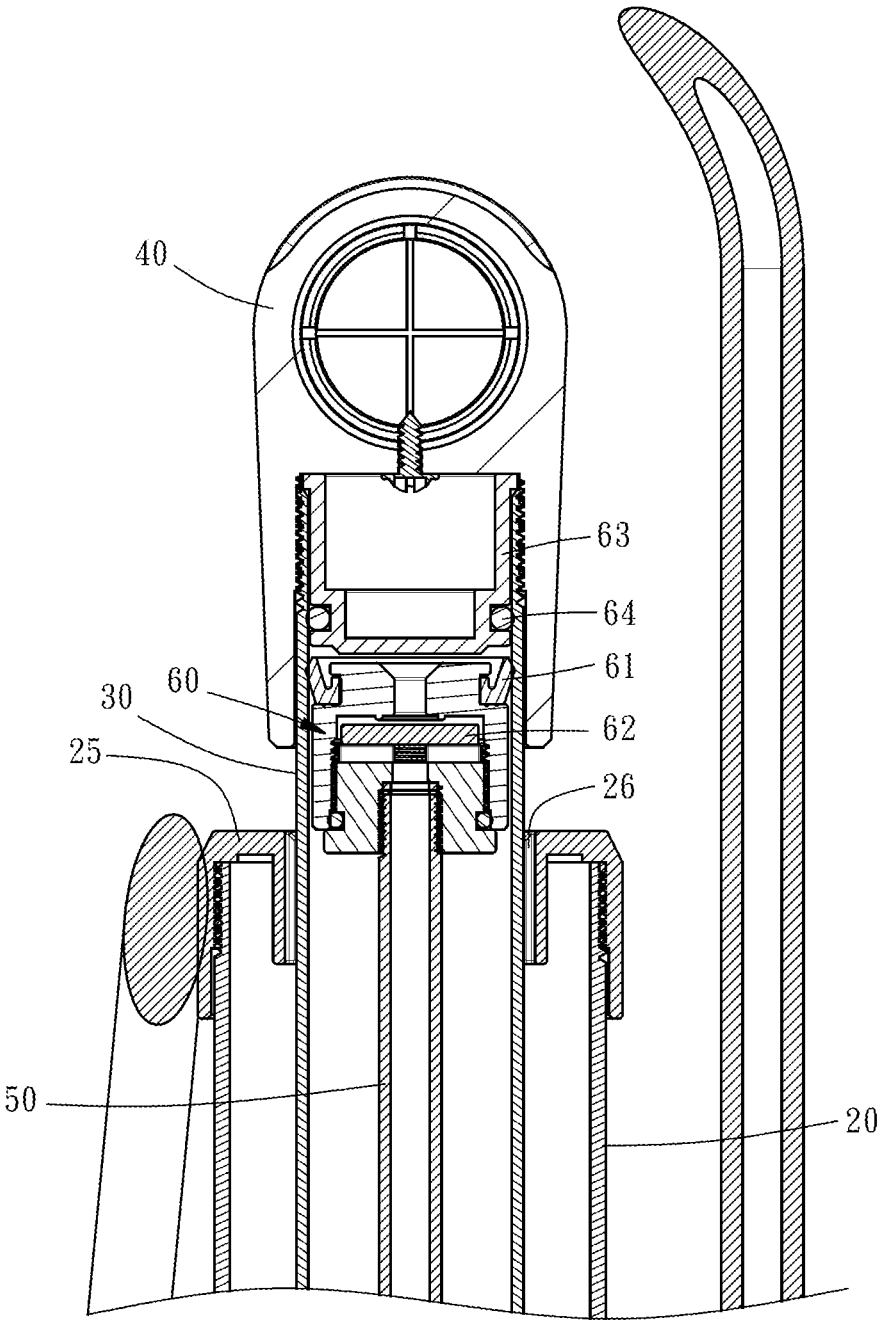
FIG. 8 is an enlarged view of the middle, upper, and handle-related parts of FIG. 3.

Referring to FIG. 8, the internal cylinder piston 60 comprises a cup-shaped ring 61 and a unidirectional valve 62, whereas a bushing 63 and a seal ring 64 are disposed at the exposed end of the internal cylinder 30. Referring to FIG. 4, a unidirectional intake ring 72 is disposed between the external cylinder piston 70 and the external cylinder 20, a seal ring 73 is disposed between the external cylinder piston 70 and the delivery pipe 50, and a cup-shaped ring 16 is disposed between the base 10 and the external cylinder 20. Referring to FIG. 2, the internal cylinder 30 has a through hole 31 positioned proximate to the external cylinder piston 70.

Figure 3:
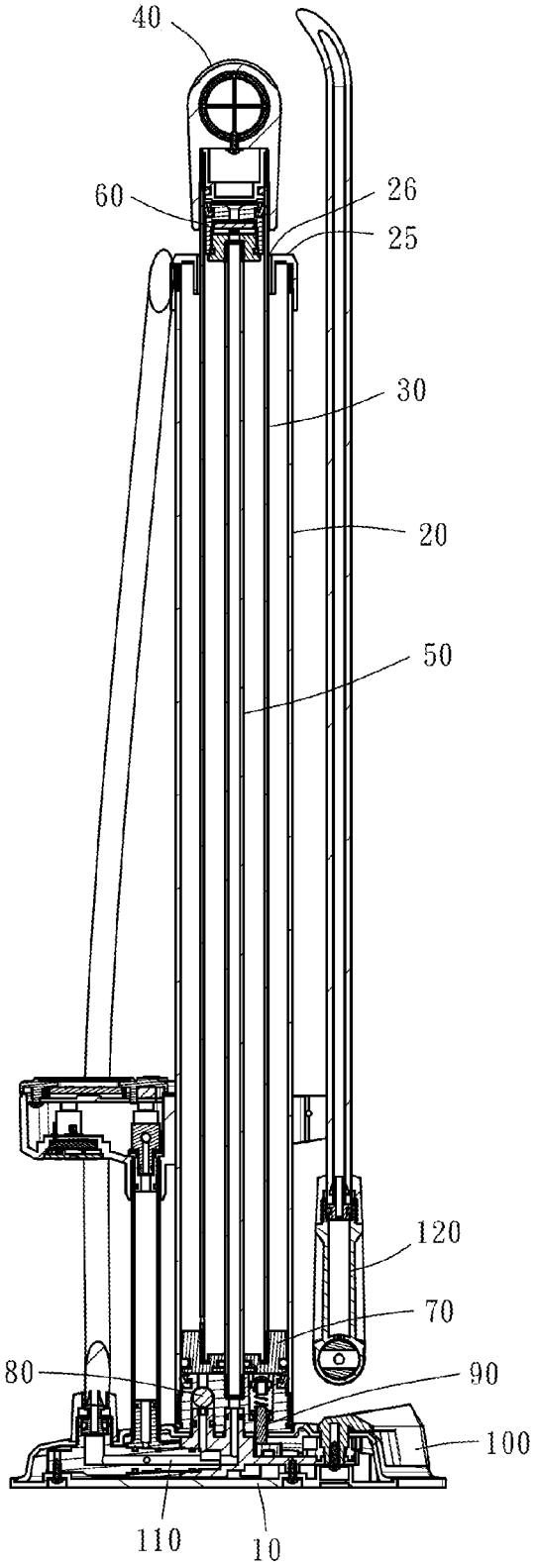
FIG. 3 is a cross-sectional view of the pump taken along line A-A of FIG. 1.

Referring to FIG. 3, the external cylinder 20 and the internal cylinder 30 are divided by the external cylinder piston 70 and the internal cylinder piston 60, respectively, into an upper space and a lower space. As shown in FIG. 3, the lower space of the external cylinder 20 approximates nil, whereas the upper space of the internal cylinder 30 approximates nil.

When the handle 40 is pulled up, the lower space of the external cylinder 20 increases such that air exits the upper space of the external cylinder 20 by passing through the unidirectional intake ring 72 of the external cylinder piston 70 to feed the lower space of the external cylinder 20, whereas the upper space of the internal cylinder 30 also increases such that air exits the lower space of the internal cylinder 30 by passing through the cup-shaped ring 61 of the internal cylinder piston 60 to feed the upper space of the internal cylinder 30.

When the handle 40 is pressed down, air in the lower space of the external cylinder 20 is driven into the intake hole 12 of the base 10, but the check valve 80 prevents the air from reversing and exiting, whereas air in the upper space of the internal cylinder 30 is driven to the internal cylinder piston 60 to thereby enter the delivery pipe 50 through the unidirectional valve 62. Finally, the two air currents meet in the guide channel 110 and then exit through the nozzle 120.

When the handle 40 is pressed down, external air enters the upper space of the external cylinder 20 through a gap between the end fitting element 25 and the internal cylinder 30 and then enters the lower space of the internal cylinder 30 through the through hole 31.

When the control element 100 is located at the position shown in FIGS. 4, 6, the discharge valve 90 is closed such that both the internal cylinder 30 and the external cylinder 20 are functioning while a pumping process is underway. The pumping process features large-volume pumping and performs best at low pressure.

When the control element 100 is moved to the position shown in FIGS. 5, 7, the discharge valve 90 is open; meanwhile, the external cylinder 20 becomes disabled such that the gas therein is discharged through the discharge valve 90, leaving the internal cylinder 30 to function alone. The pumping process features small-volume pumping and performs best at high pressure.

According to the present invention, the valve body 91 of the discharge valve 90 provides a hermetic seal to the valve hole 15 from within the cylinders to thereby achieve optimal airtightness during the pumping process. Furthermore, the higher the internal pressure is during the pumping process, the better the airtightness is, thereby precluding a leak.

Although this embodiment is exemplified by a floor pump, mini pumps are also applicable to this embodiment.

What is claimed is:

1. A pump operable in one of a quick pumping mode and a high-pressure pumping mode selectively, comprising:

a base centrally provided with a through hole flanked by an intake hole and a discharge hole;

an external cylinder with an end fixed to the base;

an end fitting element disposed at another end of the external cylinder and centrally provided with a through hole;

an internal cylinder insertedly disposed into the through hole of the end fitting element and thereby partially received in the external cylinder so as to fit coaxially inside the external cylinder;

a handle fixed to an exposed end of the internal cylinder;

a delivery pipe with an end fixed to the through hole of the base and thereby is received coaxially in the internal cylinder;

an internal cylinder piston fixed to another end of the delivery pipe and received in the internal cylinder;

an external cylinder piston fixed to an inner end of the internal cylinder, received in the external cylinder, and centrally provided with a through hole penetrated by the delivery pipe;

a check valve disposed in the intake hole of the base to allow a gas in the external cylinder to unidirectionally enter the base but not allow the gas to reverse and exit;

a discharge valve disposed in the discharge hole of the base;

a control element for controlling an opening and closing of the discharge valve;

a guide channel in communication with the through hole and the intake hole of the base; and a nozzle connected to the guide channel;

wherein the discharge hole of the base has a receiving chamber, with a valve hole disposed at a bottom of the receiving chamber and adapted to be in communication with an outside, and the discharge valve comprises: a valve body having a rod-shaped body portion with an end having a protruding shoulder portion, wherein the rod-shaped body portion is received in the valve hole, and a free end of the body portion protrudes from the valve hole, with the shoulder portion disposed in the receiving chamber; a spring with an end abutting against the shoulder portion of the valve body and another end fixed in place inside the receiving chamber to push the valve body such that the valve body closes the valve hole; and a seal ring for fitting around the body portion, abutting against the shoulder portion, and facing the valve hole, so as to prevent a leak, wherein the control element pushes the body portion of the valve body from outside to open and close the discharge hole.

2. The pump operable in one of a quick pumping mode and a high-pressure pumping mode selectively according to claim 1, wherein the control element is slender, is centrally, pivotally connected to a lateral side of the base by a shaft, and has an end being arcuate and disposed below the valve body of the discharge valve, with the arcuate end having a thin end and a thick end, wherein another end of the control element is disposed outside the base and rotatable under an external force.

3. A pump operable in one of a quick pumping mode and a high-pressure pumping mode selectively, comprises an external cylinder and an internal cylinder, with the external cylinder having therein a discharge valve, the discharge valve having a valve body and a valve hole, the valve body having a rod-shaped body portion, the body portion having an end with a protruding shoulder portion, the body portion being insertedly disposed into the valve hole, wherein a seal ring fits around the body portion and abuts against the shoulder portion, wherein a spring abuts against the shoulder portion such that the seal ring provides a hermetic seal to the valve hole from within the cylinders, wherein a control element pushes the valve body from outside to control an opening and closing of the discharge valve.

4. The pump operable in one of a quick pumping mode and a high-pressure pumping mode selectively according to claim 3, wherein a free end of the body portion of the valve body protrudes from the valve hole, and the control element pushes the free end of the body portion of the valve body from outside.

* * * * *